US008507065B2

(12) United States Patent
Milson

(10) Patent No.: US 8,507,065 B2
(45) Date of Patent: Aug. 13, 2013

(54) LABEL WITH REGION FOR RE-PASTING

(75) Inventor: Robert Milson, Essex (GB)

(73) Assignee: Sato Holdings Kabushiki Kaisha (JP)

( * ) Notice: Subject to any disclaimer, the term of this patent is extended or adjusted under 35 U.S.C. 154(b) by 231 days.

(21) Appl. No.: 13/121,203

(22) PCT Filed: Dec. 11, 2008

(86) PCT No.: PCT/JP2008/072485

§ 371 (c)(1),
(2), (4) Date: Mar. 28, 2011

(87) PCT Pub. No.: WO2010/035353

PCT Pub. Date: Apr. 1, 2010

(65) Prior Publication Data

US 2011/0177277 A1 Jul. 21, 2011

(30) Foreign Application Priority Data

Sep. 29, 2008 (JP) ..... 2008-251319

(51) Int. Cl.

| | |
|---|---|
| ***B32B 9/00*** | (2006.01) |
| ***B32B 33/00*** | (2006.01) |
| ***B65D 65/28*** | (2006.01) |
| ***G09F 3/02*** | (2006.01) |

(52) U.S. Cl.
USPC ..... 428/40.1; 428/41.8; 428/42.2; 428/42.3; 428/43

(58) Field of Classification Search
USPC ..... 428/40.1, 40.5, 41.8, 42.1–43; 283/72, 283/81, 100, 101, 105; 40/299.01, 312, 638
See application file for complete search history.

(56) References Cited

U.S. PATENT DOCUMENTS 3,914,483 A * 10/1975 Stipek, Jr. ..... 428/42.3
4,032,679 A * 6/1977 Aoyagi ..... 428/42.3

(Continued)

FOREIGN PATENT DOCUMENTS

JP 2002-175014 A 6/2002
JP 2008-191549 A 8/2008

OTHER PUBLICATIONS

International Search Report dated , issued in corresponding international application No. PCT/PCT/JP2008/072485.

*Primary Examiner* — Patricia Nordmeyer
(74) *Attorney, Agent, or Firm* — Ostrolenk Faber LLP

(57) ABSTRACT

A label having a region for re-application, capable of ensuring a tensile strength of a strip-shaped backing liner from which label main bodies have been separated even when a region for re-application is provided in a wide range across a width direction. This label includes: label main bodies 2 with a back surface to which an adhesive 3 is applied and with regions for re-application 21, and a strip-shaped backing liner 1 along which the plurality of label main bodies 2 are arranged and temporarily attached at intervals. The strip-shaped backing liner 1 includes a plurality of re-separation backing partial regions 12 at intervals across a width direction perpendicular to the arrangement direction so as to correspond to the region for re-application 21 defined in each label main body 2. Each re-separation backing partial region of the liner being provided over a range wider than the region for re-application 21 in a direction of the arrangement of the label main bodies 2. A region between the adjacent re-separation backing regions 12 in the width direction and not temporarily attached in the back surface of the region for re-application 21 is processed as a non-adhesive region 31.

4 Claims, 11 Drawing Sheets

(56) References Cited

U.S. PATENT DOCUMENTS 4,995,642 A * 2/1991 Juszak et al. ..... 283/105
5,484,168 A * 1/1996 Chigot ..... 283/67
5,512,343 A * 4/1996 Shaw ..... 428/42.1
5,958,536 A * 9/1999 Gelsinger et al. ..... 428/40.1
6,368,688 B1 * 4/2002 Crum et al. ..... 428/41.8
6,410,113 B1 * 6/2002 Roth ..... 428/41.8
2004/0007557 A1 * 1/2004 Maliszewski et al. ..... 215/365

* cited by examiner

LABEL WITH REGION FOR RE-PASTING

CROSS-REFERENCE TO RELATED APPLICATIONS

The present application is a 35 U.S.C. §§371 national phase conversion of PCT/JP2008/072485, filed Dec. 11, 2008 which claims priority of Japanese Application No. 2008-251319 filed Sep. 29, 2008, the contents of which are incorporated by reference herein. The PCT International Application was published in the Japanese language.

BACKGROUND OF THE INVENTION

1. Technical Field

The present invention relates to a label having a region enabling re-application that is re-separable from an object of application after application and re-applicable to a different object of application. In particular, it relates to a label having a region for re-application and is suitable for an automatic label separator that mechanically and automatically separates a label main body from a strip-shaped backing liner by using a release plate.

2. Background Art

A courier label which is often used in package delivery may comprise a label having a region for re-application that is re-separable from an object of application after application to the object and that is re-applicable to a different object of application. The region for re-application may be used as a return label that indicates a destination address for returning, or as a tracking label for the courier company by applying the region for re-application to a different delivery document (see Japanese Unexamined Patent Application Publication No. 2008-191549 for example).

A conventional label having a region for re-application is described with reference to FIG. 10 and FIG. 11 hereof.

FIGS. 10(*a*)-(*d*) is an illustration of a structure of a conventional label having a region for re-application, in which (a) is a plan view, (b) is a cross-sectional view taken along line Y-Y' shown in (a), and (c) and (d) are illustrative views explaining its usage. FIG. 11 is a perspective view explaining separating a label main body from a strip-shaped backing liner using a release plate in the label having a region for re-application.

Referring to FIG. 10(*a*) and FIG. 10(*b*), the conventional label having a region for re-application is configured as a strip-shaped backing liner 1 in a shape of a strip on which are applied label main bodies 2. Each body has a back surface on which an adhesive 3 is applied. The adhesive 3 is applied to the back surface of each label main body 2. The plurality of label main bodies 2 are temporarily attached to the strip-shaped backing liner 1 at predetermined intervals by the adhesives 3 applied to the back surfaces. Here, the cross-sectional view shown in FIG. 10(*b*) is enlarged in a thickness direction for the sake of explanation.

Each label main body 2 is provided with regions for re-application 21 each enclosed by a label separation cutting line 4 in a closed state. The regions 21 are separable from the label main body 2 such that the regions for re-application 21 can be used, for example, as a return label indicating a destination address for returning and as a tracking label for the courier company.

Further, the strip-shaped backing liner 1 is provided with re-separation backing regions 11 each enclosed by a backing separation cutting line 5 in a closed state and the regions 11 are separable from the strip-shaped backing liner 1 such that each region 11 contains the corresponding region for re-application 21 provided for the label main body 2, that is, each region includes the corresponding region for re-application 21 therein and has an area wider than that of the region for re-application 21.

Referring to FIG. 10(*c*), the conventional label having a region for re-application as described above is used by separating the back surface of the label main body 2 from the strip-shaped backing liner 1 excluding the re-separation backing regions 11 to expose the adhesive 3, and applying the label main body 2 to which the re-separation backing regions 11 are temporarily attached to an object of application 6 by the exposed adhesive 3. After the application to the object of application 6, as shown in FIG. 10(*d*), the regions for re-application 21 can be re-applied to different objects of application by separating the regions for re-application 21 from the re-separation backing regions 11.

When applying a large quantity of conventional labels having a region for re-application, an automatic label separator that mechanically and automatically performs separation using a release plate 7 is used in separating each main body 2 from the strip-shaped backing liner 1 excluding the re-separation backing regions 11. See FIG. 11. Such an automatic label separator separates the label main bodies 2 from the strip-shaped backing liner 1 excluding the re-separation backing regions 11 by, as shown in FIG. 11, folding back the strip-shaped backing liner 1 using the release plate 7 and transferring only the strip-shaped backing liner 1 toward a downstream side indicated by an arrow.

However, with the conventional technique, when the regions for re-application 21 are provided in a wide range across a width direction that is perpendicular to the transfer direction, the re-separation backing regions 11 are naturally provided in a range wider than the corresponding regions for re-application 21 across the width direction, and a distance between the regions for re-application 21 and a side end becomes narrow. As this consequently reduces a tensile strength of the strip-shaped backing liner 1 from which the label main bodies 2 have been separated in the transfer direction when using the automatic label separator, there is a problem that the strip-shaped backing liner 1 can tear when transferring only the strip-shaped backing liner 1 that has been folded back using the release plate 7 to the downstream side.

SUMMARY OF INVENTION

Technical Problem

The present invention has been made in view of the above problem. An object of the present invention is to provide a label having a region for re-application, wherein the label is capable of ensuring a tensile strength of a strip-shaped backing liner from which label main bodies have been separated even when the region for re-application is provided in a wide range across a width direction.

Solution to Problem

In order to solve the above problem, the present invention provides structures described below.

The invention comprises a label having a region for re-application configured to be re-separated from an object of application after initial application and re-applied to a different object of application. The label comprises: a plurality of label main bodies, each having a back surface to which an adhesive is applied and the region for re-application is defined by a label separation cutting line in a closed state. There is a strip-shaped backing liner in a shape of a strip along which the plurality of label main bodies are arranged and temporarily attached at intervals, wherein the strip-shaped backing liner is provided with a plurality of re-separation backing regions at intervals across a width direction perpendicular to the arrangement direction so as to correspond to the region for re-application defined in each label main body. Each re-separation backing region is defined by a backing separation cutting line in a closed state and is provided over a range wider than the region for re-application in a direction of the arrangement of the label main bodies, and a region between the adjacent re-separation backing regions in the width direction and not temporarily attached in the back surface of the region for re-application is processed as a non-adhesive region.

Further, the re-separation backing regions on both ends across the width direction are provided so as to respectively include both end portions of the region for re-application across the width direction.

Moreover, a pickable portion enclosed by the label separation cutting line in a closed state is provided continuously from one of the end portions of each region for re-application across the width direction, as a portion from which separation of the corresponding region for re-application starts, and the non-adhesive region is provided so as to slightly extend over the re-separation backing regions on both sides in the width direction.

Advantageous Effects of Invention

The label having a region for re-application of the present invention includes label main bodies, each provided with a back surface to which an adhesive is applied. The region for re-application is defined by a label separation cutting line in a closed state. A strip-shaped backing liner is in a shape of a strip along which the plurality of label main bodies are arranged and temporarily attached at intervals. The strip-shaped backing liner is provided with a plurality of re-separation backing regions at intervals across a width direction, perpendicular to the arrangement direction, so as to correspond to the region for re-application defined in each label main body. Each re-separation backing region is defined by a backing separation cutting line in a closed state and provided over a range wider than the region for re-application in a direction of the arrangement of the label main bodies. A region between the adjacent re-separation backing regions in the width direction and not temporarily attached in the back surface of the region for re-application is processed as a non-adhesive region. With this, as the region between the adjacent re-separation backing regions remains, even after the label main body has been separated and the re-separation backing regions have been removed, it is possible to ensure the tensile strength of the strip-shaped backing liner from which the label main body has been separated in the arrangement direction even when the regions for re-application are provided in a wide range across the width direction perpendicular to the arrangement direction. Consequently, there is an advantageous effect that the strip-shaped backing liner may not be torn when the label main body is separated from the strip-shaped backing liner by transferring the strip-shaped backing liner along the arrangement direction using the automatic label separator.

Further, because the label has a region for re-application according to the present invention, the re-separation backing regions on both ends across the width direction respectively include both end portions of the region for re-application across the width direction. This has an advantageous effect that the adhesive is applied on both end portions of the back surface of the separated region for re-application in the width direction and it is possible to apply the separated region for re-application to a different object of application without causing both end portions to lift.

Moreover, according to a label having a region for re-application of the present invention, a pickable portion enclosed by the label separation cutting line in a closed state is provided continuously from one of the end portions of each region for re-application across the width direction, as a portion from which separation of the corresponding region for re-application starts. In addition, the non-adhesive region extends slightly over the re-separation backing regions on both sides in the width direction. This has an advantageous effect that it is possible to separate the region for re-application from the re-separation backing region smoothly when separating in the width direction.

DESCRIPTION OF A PREFERRED EMBODIMENT

Figure 1:
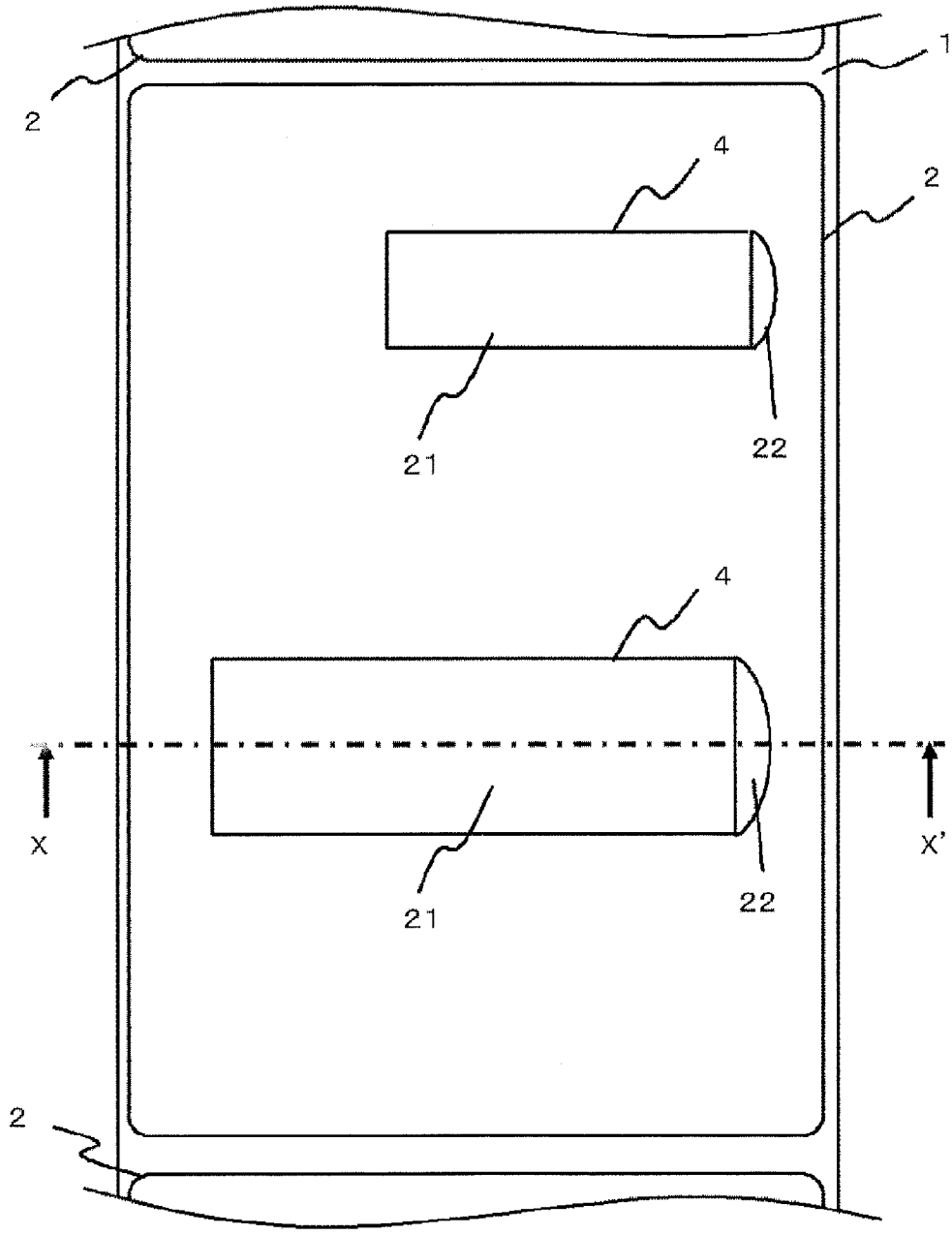
FIG. 1 is a plan view illustrating a label having a region for re-application, of an embodiment according to the present invention, viewed from the side of the label carrying a label main body.

The following describes an embodiment of the present invention with reference to the drawings.

Referring to FIG. 1 to FIG. 4, the label having a region for re-application of this embodiment comprises a strip-shaped backing liner 1 in a shape of a strip and label main bodies 2 on the liner. Each body 2 is provided with a back surface on which an adhesive 3 is applied. The plurality of label main bodies 2 are temporarily attached to the strip-shaped backing liner 1 at predetermined intervals by the adhesives 3 applied to the back surfaces. The cross-sectional view shown in FIG.

4 is enlarged in the thickness direction for the sake of explanation. Further, in this embodiment, an up-down direction in each of FIG. 1 to FIG. 3 along which the plurality of label main bodies 2 are arranged at intervals along the strip-shaped backing liner 1 is referred to as an arrangement direction, and a direction that is perpendicular to the arrangement direction in FIG. 1 to FIG. 3 is referred to as a width direction.

Each label main body 2 is provided with two regions for re-application 21. Each region 21 is enclosed by a label separation cut line 4 in a closed state around the periphery of the region 21 and these regions are separable from the label main body 2. As a result, the regions for re-application 21 can be used, for example, as a return label indicating a destination address for returning the object carrying that return label and or as a tracking label for a courier company. In addition, pickable or holding portions 22, each enclosed by the corresponding label separation cut line 4 in a closed state are provided at and continuously from the respective regions for re-application 21 on one end of the region across the width direction. Separation of the corresponding region for re-application 21 starts at its portion 22. With the foregoing, the region for re-application 21 can be easily separated from the pickable portion 22 in the width direction. Here, each label separation cut line 4 is cut partly or a wholly through the thickness of the label main body 2. The cut line can be provided around an entire circumference or can comprise perforations in a regular or a random pattern. The regions for re-application 21 and the pickable portions 22 are subjected to a so-called full-cutting or half-cutting process. Further, it is preferable that the label separation cut line 4 between the pickable portion 22 and the region for re-application 21 be formed of perforations or formed by half-cutting, and that the remaining portion of the label separation cut line 4 around the pickable portion 22 be formed by full-cutting. As the pickable portion 22 can be easily picked and is also continuous from the corresponding region for re-application 21, it is possible to split the pickable portion 22 off from the region for re-application 21 after separating the region for re-application 21 while holding the pickable portion 22.

Figure 2:
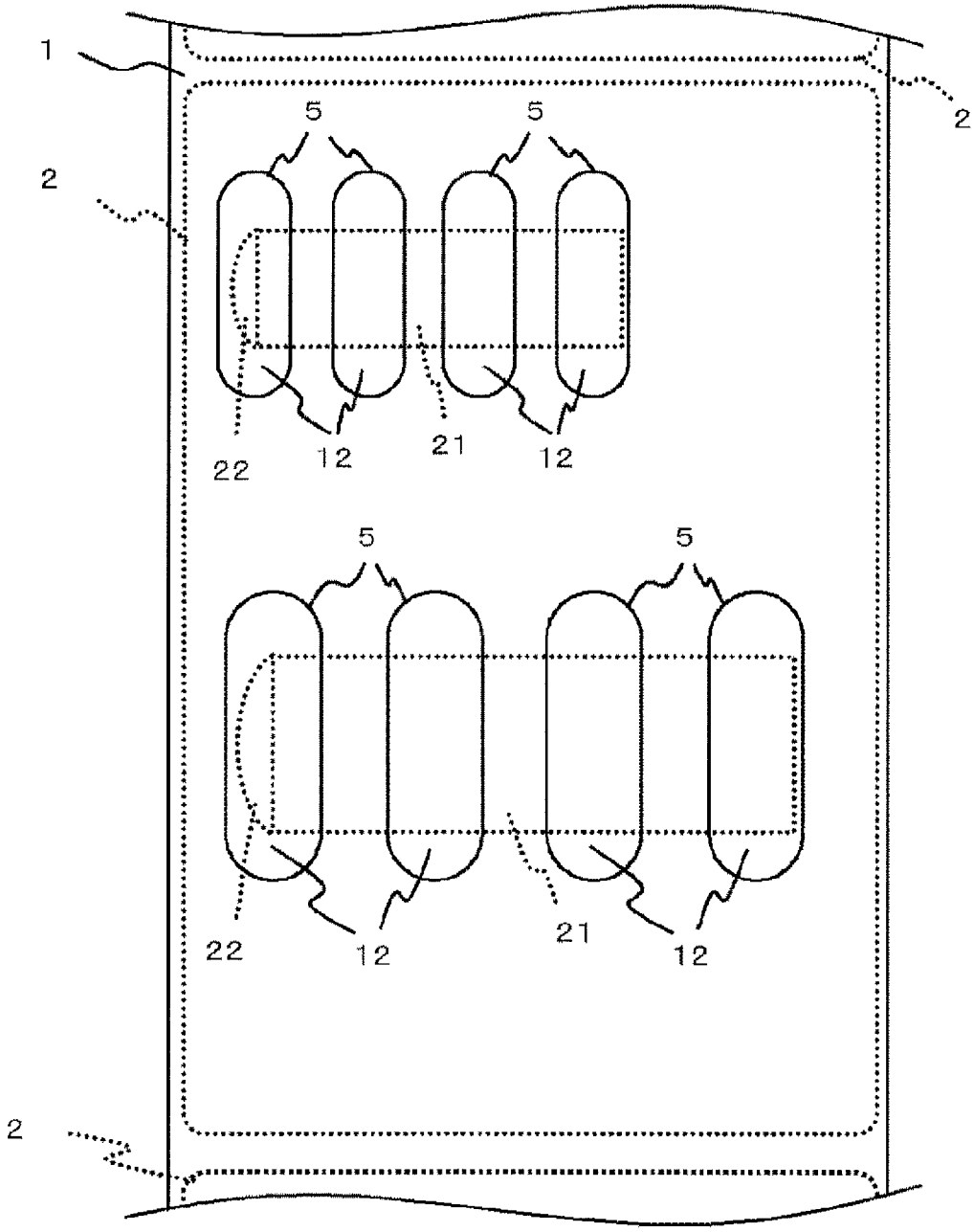
FIG. 2 is a plan view illustrating the label having a region for re-application of the embodiment according to the present invention, viewed from the side of the label with a strip-shaped backing liner.

Referring to FIG. 2, four re-separation backing partial regions 12 are provided in the body of the strip-shaped backing liner 1 at spaced intervals across the width direction at regions corresponding to each of the two regions for re-application 21 provided on the label main body 2. Each re-separation backing partial region 12 is enclosed by a backing separation cut line 5 which surrounds its region 12 in a closed state. Each re-separation backing partial region 12 extends over a range wider than the corresponding region for re-application 21 of the label main body 2 in the arrangement direction. In addition, the re-separation backing partial regions 12 on both ends across the width direction are positioned so as to respectively include both end portions of each region for re-application 21 across the width direction, as well as the pickable portion 22 for the end portion from which the pickable portion 22 is continuously provided. Here, each backing separation cut line 5 is cut through an entire thickness of the strip-shaped backing liner 1 for an entire circumference, and the re-separation backing partial regions 12 are subjected to the so-called full-cut process.

Figure 3:
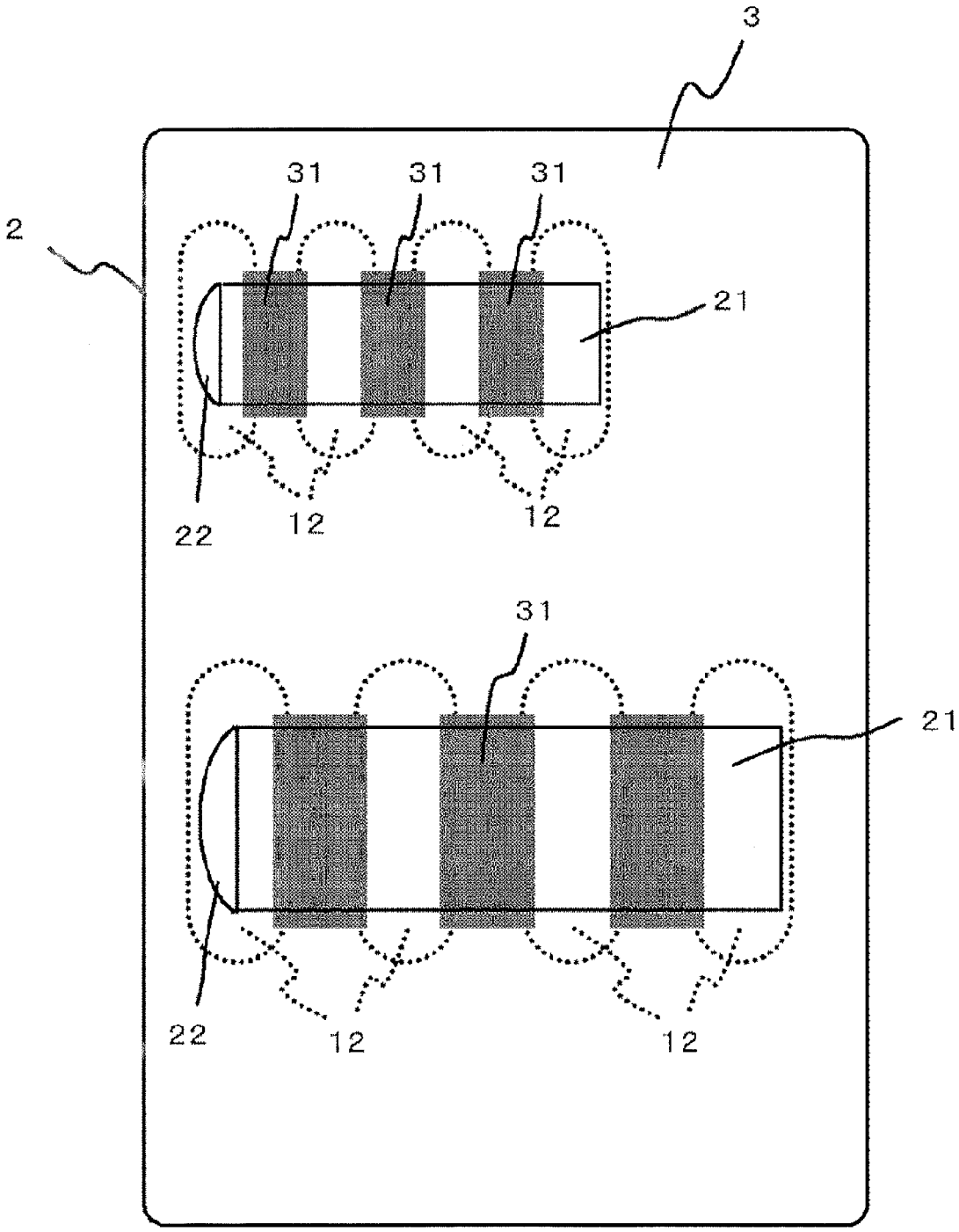
FIG. 3 is a plan view illustrating a back surface of the label main body shown in FIG. 1.

Referring to FIG. 3, on the back surface of the label main body 2 to which the adhesive 3 is applied, regions in each region for re-application 21 to which the re-separation backing partial regions 12 are not temporarily attached, each of which is between the adjacent re-separation backing partial regions 12 in the width direction, are non-adhesive regions 31 to which a material such as silicone is applied so as to thereby avoid an effect of an adhesive force of the adhesive 3. Here, the non-adhesive regions 31 can be wider than the regions for re-application 21 in the arrangement direction or slightly extend over the re-separation backing partial regions 12 on both sides, as shown in FIG. 3, as long as the non-adhesive regions 31 at least include the regions in each region for re-application 21 to which the re-separation backing partial regions 12 are not temporarily attached, each of which is between the re-separation backing partial regions 12. In this case, it is desirable that the area of the non-adhesive regions 31 be as small as possible, as an adhesive force applied by the region for re-application 21 to a different object of application is reduced if this area is large.

Here, tensile strength of the strip-shaped backing liner 1 in the arrangement direction is increased as the number of the re-separation backing partial regions 12 provided in the width direction is decreased, as the width of the re-separation backing partial regions 12 is decreased, and as the distance between the adjacent re-separation backing partial regions 12 in the width direction is increased. However, in this case, as the region between the adjacent re-separation backing partial regions 12 in the width direction is processed as the non-adhesive region 31, only the regions to which the re-separation backing partial regions 12 are temporarily attached in the corresponding region for re-application 21 are used as adhesive surfaces for applying the region for re-application 21 to a different object of application. This reduces the adhesive force when applying the region for re-application 21 to the different object of application. Further, the adhesive force when applying the region for re-application 21 to a different object of application is increased as the number of the re-separation backing partial regions 12 provided in the width direction is increased, and the width of the re-separation backing partial regions 12 is increased, and the distance between the adjacent re-separation backing partial regions 12 in the width direction is decreased. However, in this case, as the strip-shaped backing liner 1 excluding the re-separation backing partial regions 12 in the width direction becomes smaller around a portion at which the re-separation backing partial regions 12 are provided, the tensile strength of the strip-shaped backing liner 1 in the arrangement direction is reduced. Therefore, it is desirable that the number of the re-separation backing partial regions 12 provided in the width direction, the width of the re-separation backing partial regions 12, and the distance between the adjacent re-separation backing partial regions 12 in the width direction be set appropriately according to a tensile strength of the strip-shaped backing liner 1 in the arrangement direction desired to be ensured and an adhesive force desired to be ensured when applying the region for re-application 21 to a different object of application.

Next, a usage of this embodiment is described with reference to FIG. 5 to FIG. 8.

Figure 5:
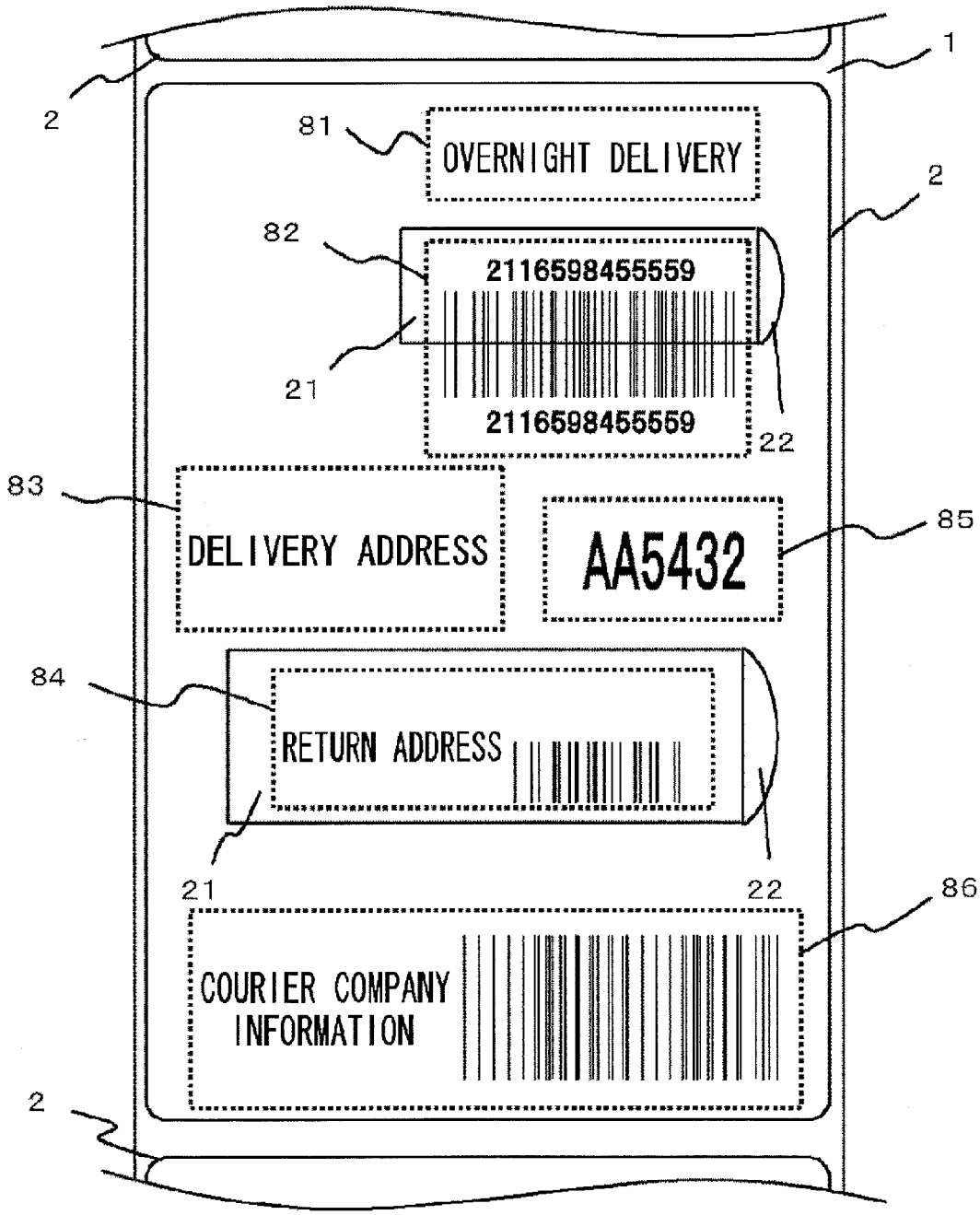
FIG. 5 is a plan view illustrating an exemplary printing of a courier label example.

In using the label having a region for re-application according to this embodiment, first, printing is carried out on a surface of the label main body 2, as shown in FIG. 5, using a printer that is not shown in the drawings. Here, FIG. 5 shows exemplary printing when the label having a region for re-application of this embodiment is used as a courier label, on which a service indication 81 specifying a delivery service such as a delivery date, a package indication 82 indicating a package number, a delivery destination indication 83 indicating a delivery address, a return address indication 84 indicating a return address, a delivery indication 85 indicating a car number and a route number of a courier company, and a courier company indication 86 indicating a service office number of the courier company. A name, a delivery date, a package number/total quantity, and other additional information also may be printed. The package indication 82 is printed across one of the two regions for re-application 21 to be re-separated and also over a region other than the region for re-application 21 that is not to be re-separated. The first mentioned region for re-application 21 can be used for providing certification of delivery information, and can be used as a tracking label for the courier company. Further, the return address indication 84 is printed on the other of the regions for re-application 21, and this region for re-application 21 can be used as a return label.

Figure 4:
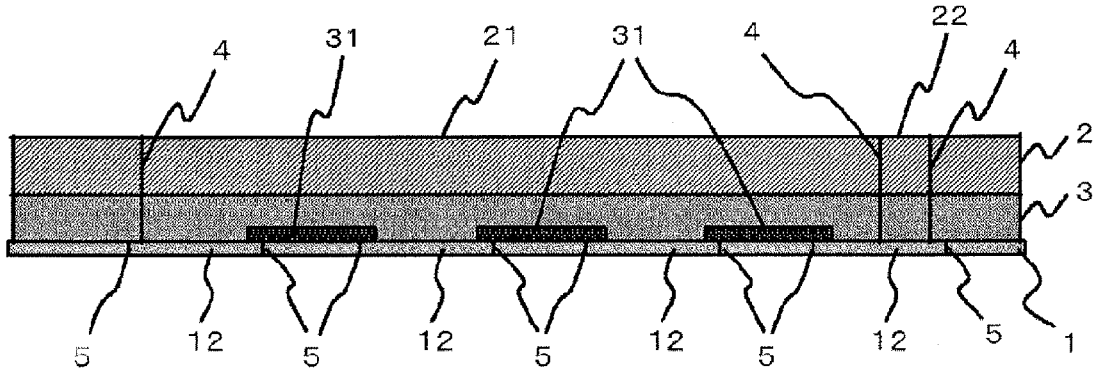
FIG. 4 is a cross-sectional view taken along line 4-4' in FIG. 1.
Figure 6:
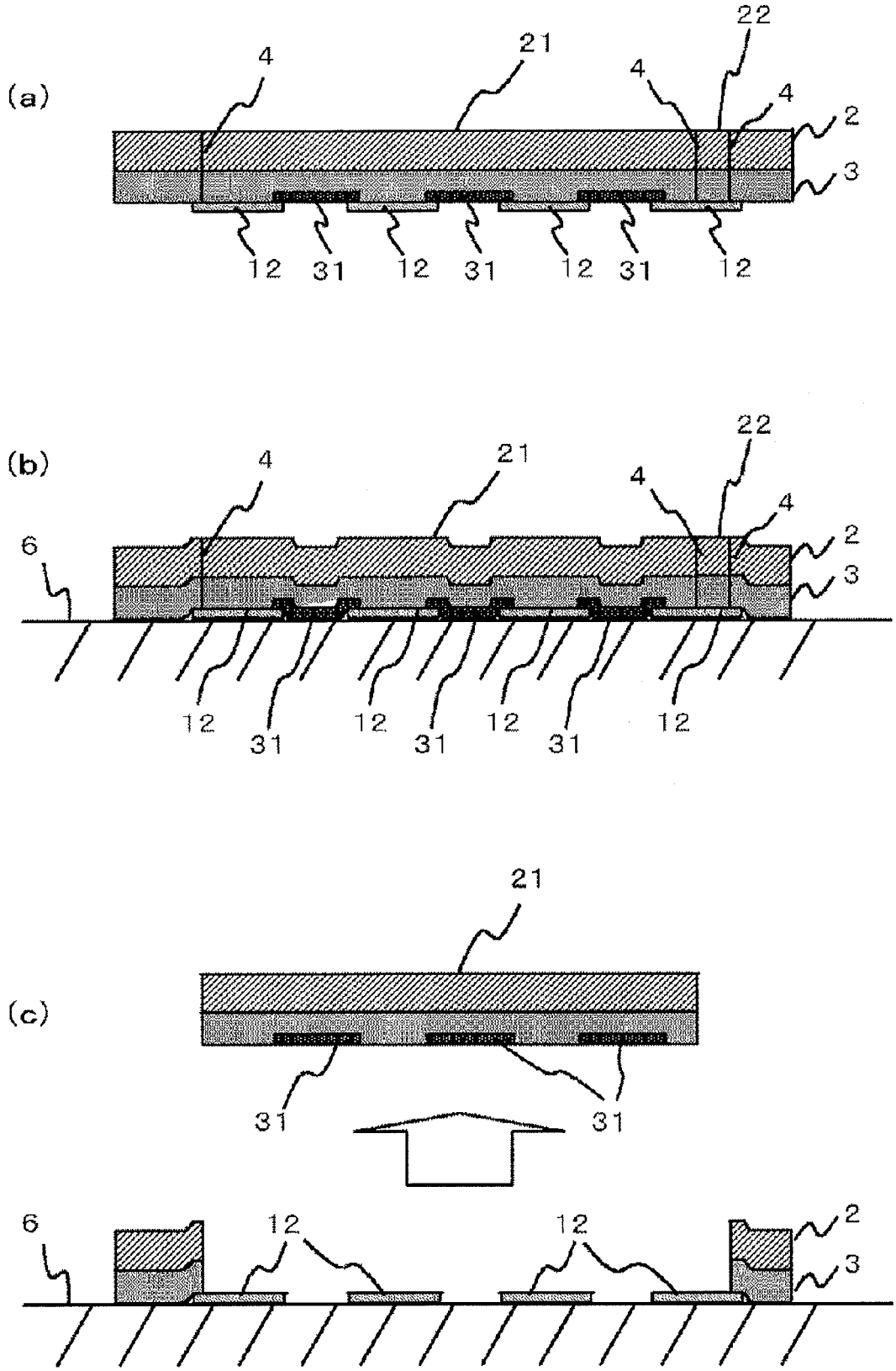
FIGS. 6 (*a*), (*b*) and (*c*) are cross sections explaining a usage of the label.

Next, the adhesive 3 is exposed by separating the back surface of the label main body 2 from the strip-shaped backing liner 1 excluding the re-separation backing partial regions 12 as shown in FIG. 6(*a*) compared with FIG. 4, and the label main body 2 while the re-separation backing partial regions 12 are temporarily attached is applied to an object of application 6 by the exposed adhesive 3, as shown in FIG. 6(*b*). When the label main body 2 is applied to the object of application 6, the regions between the adjacent re-separation backing partial regions 12 in the back surfaces of the regions for re-application 21 in the width direction are brought into contact with the object of application 6. However, as these regions are processed as the non-adhesive regions 31, the regions for re-application 21 are not applied to the object of application 6 at these regions.

Figure 7:
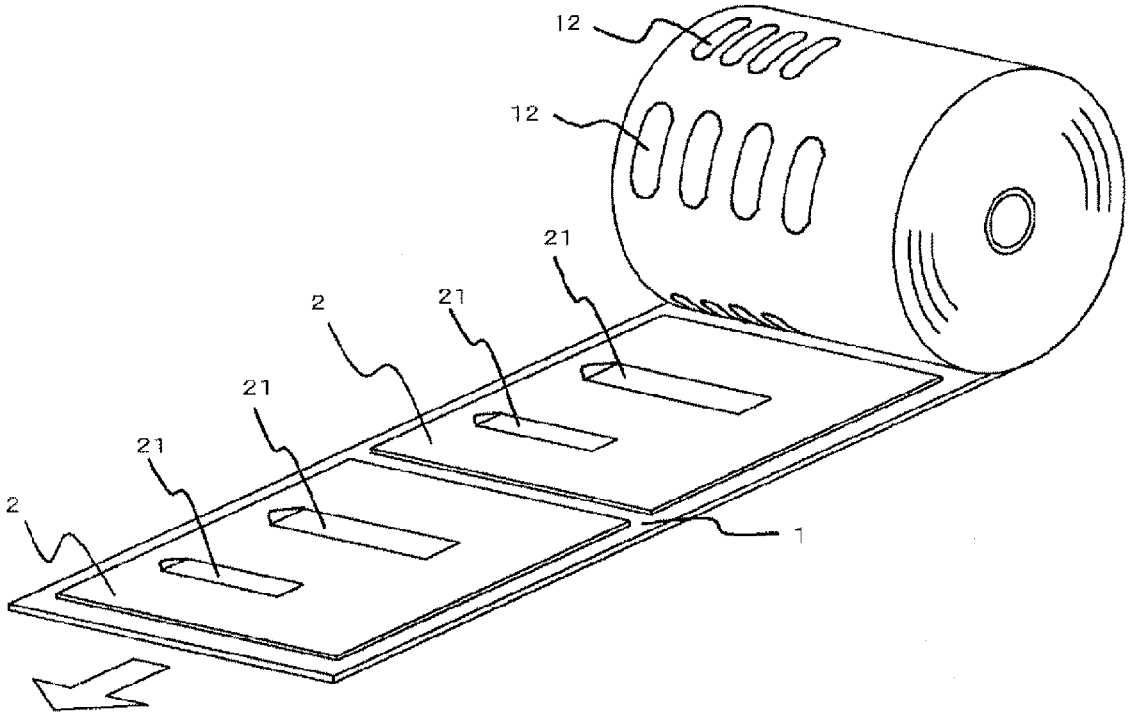
FIG. 7 is a perspective view showing the labels wound in a roll.
Figure 8:
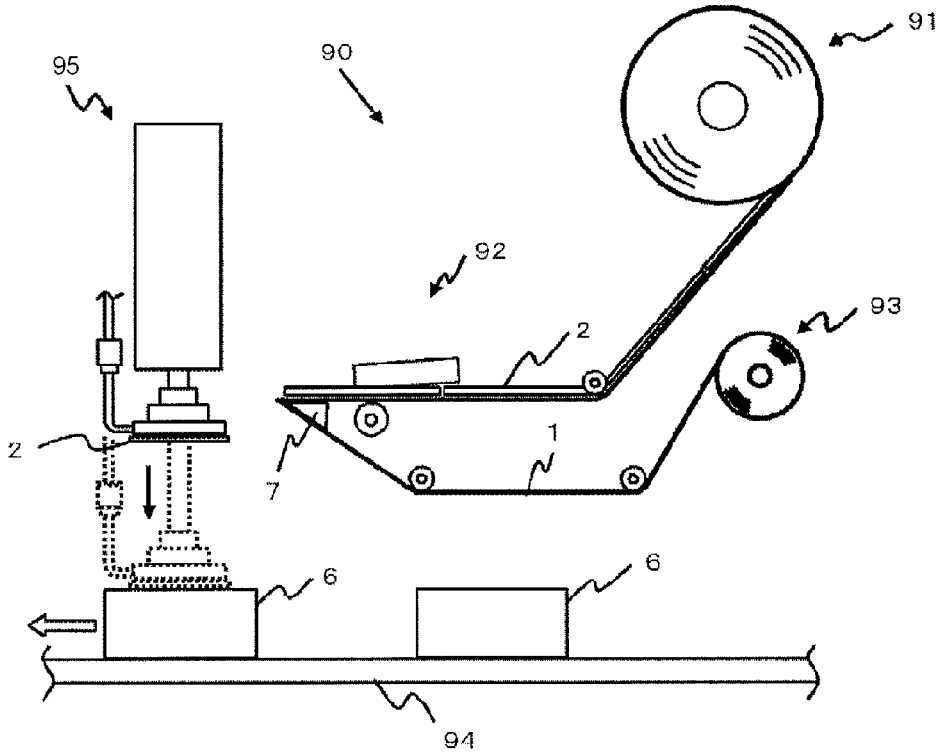
FIG. 8 is a side view schematically illustrating an automatic printing and labeling machine employing a label according to the invention.

The above described processes of printing, separating, and applying can be automated by winding the label having a region for re-application according to this embodiment into a roll as shown in FIG. 7, and by loading the roll onto an automatic printing and labeling machine 90 as shown in FIG. 8. While FIG. 7 shows the example of so-called face-in winding in which the label having a region for re-application is wound with the label main bodies 2 facing inside, it is also possible to employ so-called face-out winding in which the label having a region for re-application is wound with the label main bodies 2 facing outside.

Referring to FIG. 8, the automatic printing and labeling machine 90 is provided with a label holding unit 91 that rotatably holds the label having a region for re-application wound into a roll according to this embodiment. A printer-separator unit 92 carries out printing to the label main body 2 using a thermal print head and separates the label main body 2 after printing from the strip-shaped backing liner 1 using a release plate 7. A backing winding unit 93 winds up the strip-shaped backing liner 1 from which the label main body 2 has been separated. An applicator unit 95 applies the label main body 2 separated from the strip-shaped backing liner 1 and fed from the release plate 7 to the object of application 6 such as a package that is transferred on a conveyer 94.

Figure 9:
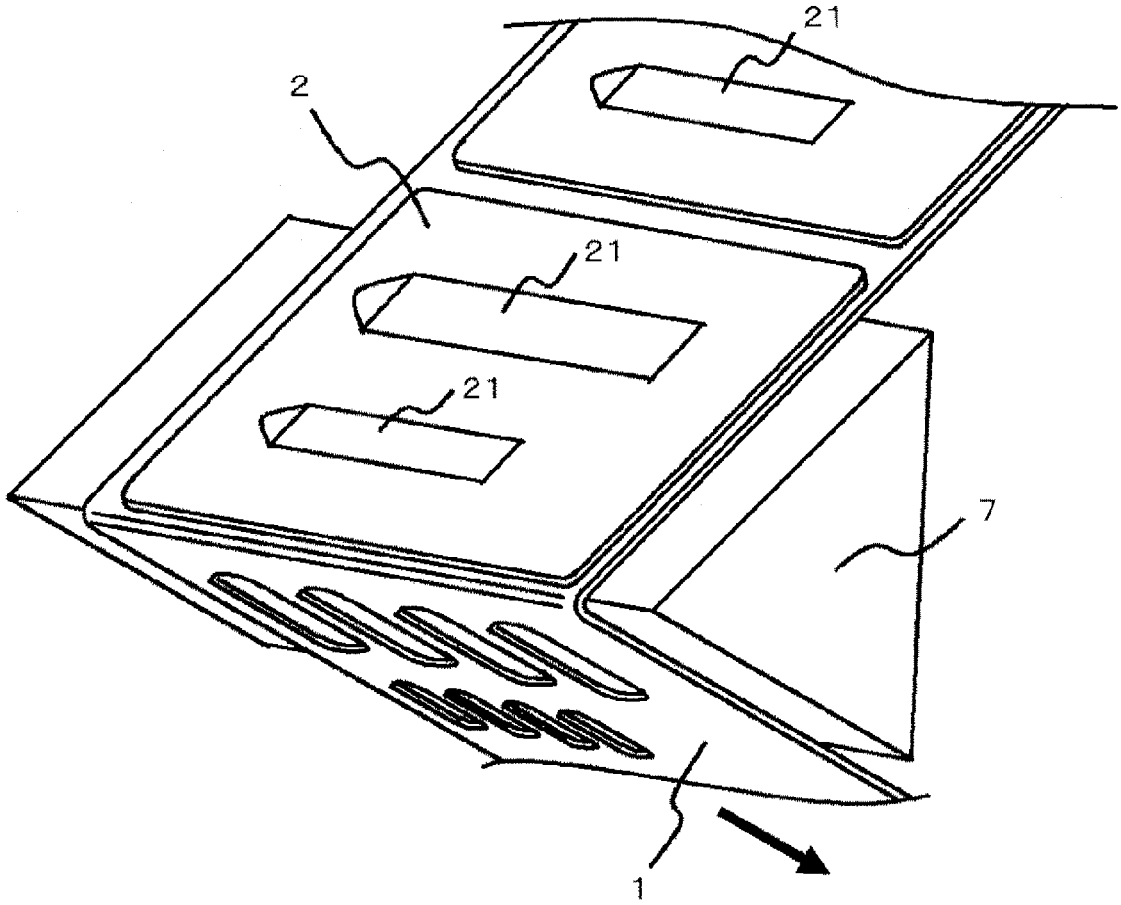
FIG. 9 is a perspective view illustrating an operation of separating the label main body from the strip-shaped backing liner using a release plate in a label having a region for re-application of an embodiment according to the present invention.
Figure 10:
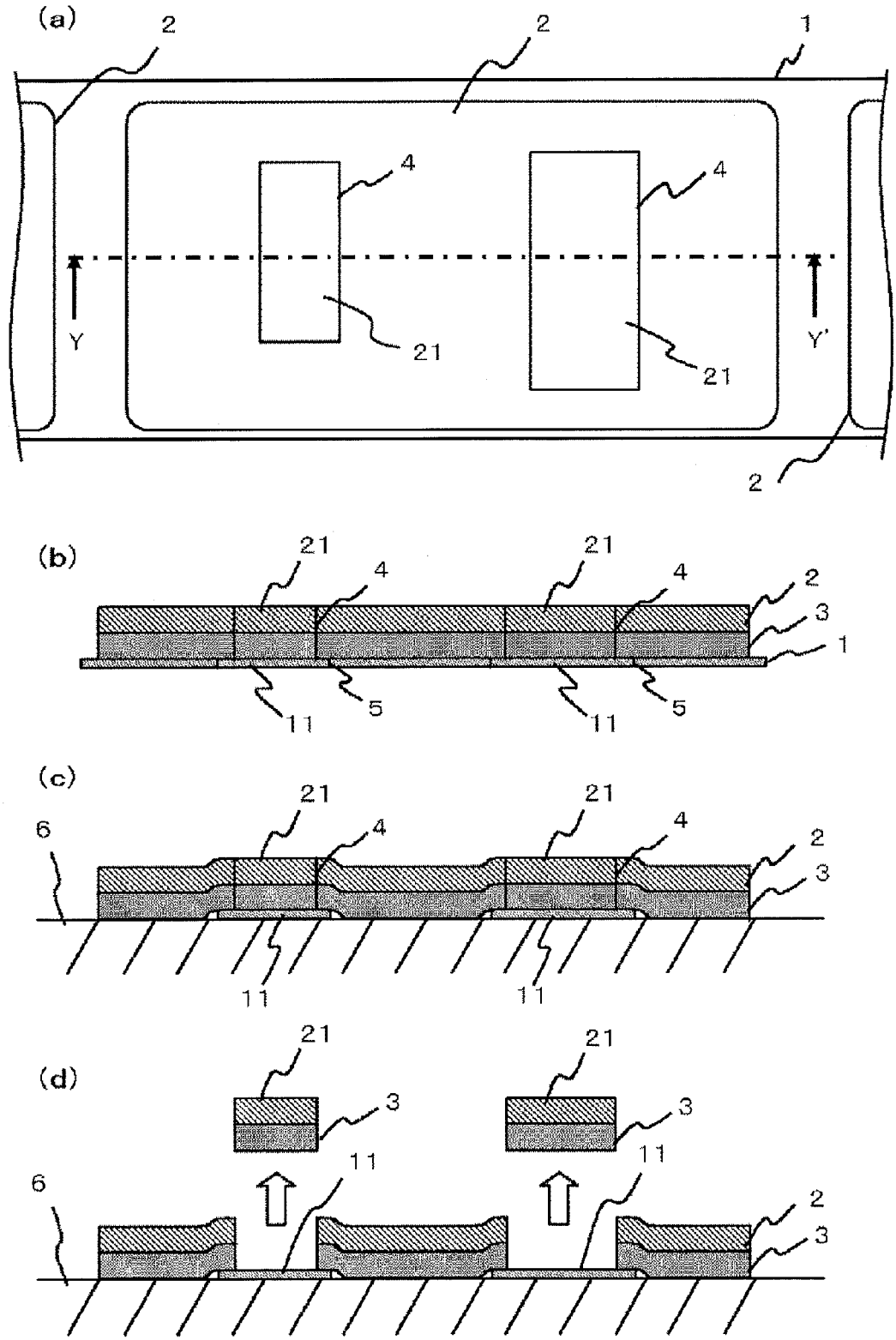
FIG. 10 illustrates a conventional label having a region for re-application, in which (a) is a plan view, (b) is a cross-sectional view taken along line Y-Y' shown in (a), and (c) and (d) are illustrative views explaining a usage.
Figure 11:
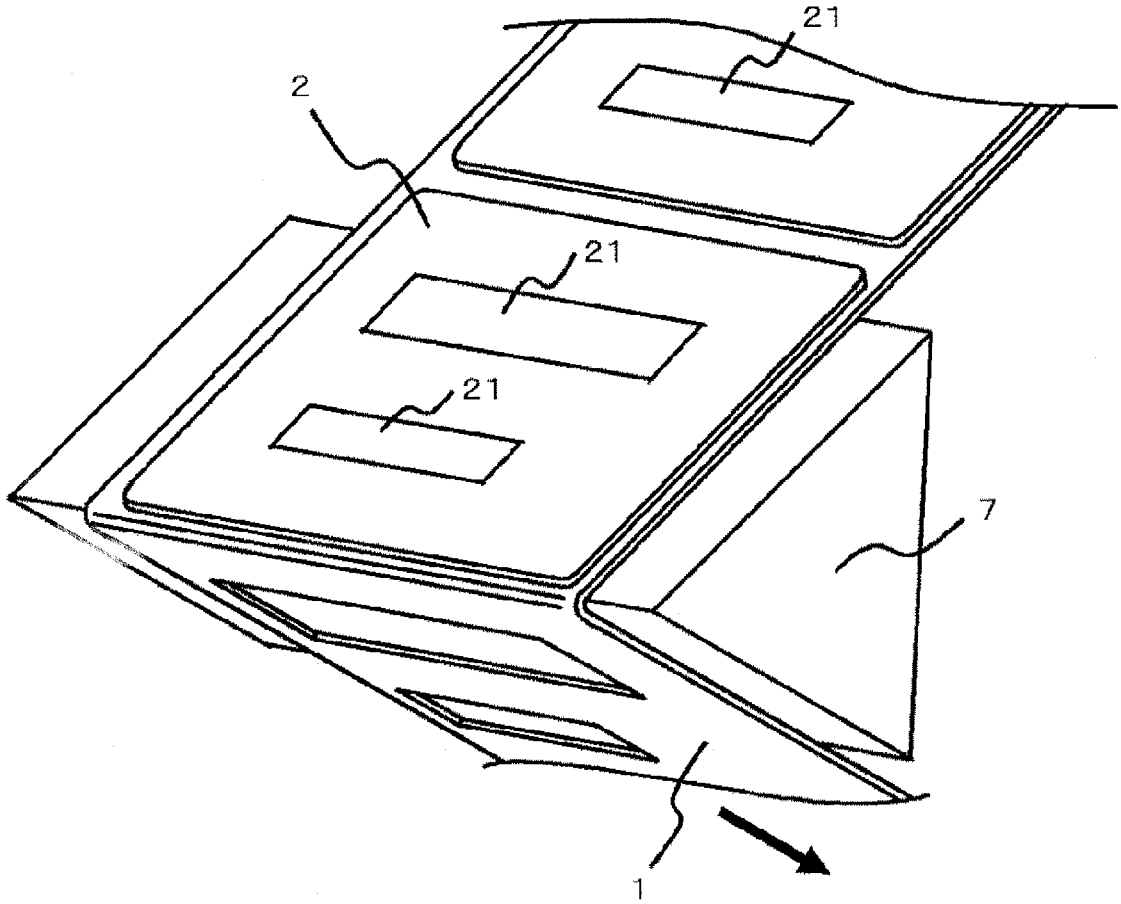
FIG. 11 is a perspective view explaining separating a label main body from a strip-shaped backing liner using a release plate in a conventional label having a region for re-application.

In the automatic printing and labeling machine 90, the arrangement direction along which the label main bodies 2 are arranged is a transfer direction, and the printing to the label main body 2 is carried out while the label having a region for re-application fed from the label holding unit 91 is held and transferred between a platen roller of the printer-separator unit 92 and the thermal print head. Further, the strip-shaped backing liner 1 is folded back at a tip of the release plate 7 as shown in FIG. 9, and the strip-shaped backing liner 1 from which the label main body 2 has been separated is transferred by the backing winding unit 93 toward a downstream side indicated by an arrow shown in FIG. 9. With this, the label main body 2 is separated from the strip-shaped backing liner 1 excluding the re-separation backing partial regions 12, and the label main body 2 separated from the strip-shaped backing liner 1 is fed from the release plate 7 and applied to the object of application 6 by the applicator unit 95. Here, the strip-shaped backing liner 1 that is transferred by the backing winding unit 93 is in a state in which, as shown in FIG. 9, the label main body 2 has been separated and the re-separation backing partial regions 12 have been removed. However, the regions between the adjacent re-separation backing partial regions 12 remain, since the re-separation backing partial regions 12 for temporarily attaching the regions for re-application 21 are provided in the width direction at an interval even when the regions for re-application 21 are provided in a wide range across the width direction. Therefore, it is possible to ensure the tensile strength in the arrangement direction of the strip-shaped backing liner 1 from which the label main body 2 has been separated.

Next, if the label main body 2 is applied to an object of application, the region for re-application 21 can be re-applied to a different object of application by separating the region for re-application 21 from the re-separation backing partial regions 12 as shown in FIG. 6(*c*). Here, separation of the regions for re-application 21 can be easily carried out in the width direction from the pickable portion 22, which is provided as the portion from which the separation starts and continuously from the regions for re-application 21 in the width direction. Further, by providing the non-adhesive regions 31 processed on the back surfaces of the regions for re-application 21 so as to slightly extend over the re-separation backing partial regions 12 on both lateral sides in the width direction, it is possible to separate the regions for re-application 21 from the re-separation backing partial regions 12 smoothly when separating in the width direction. Moreover, as the re-separation backing partial regions 12 on the both ends across the width direction are provided so as to respectively include the both end portions of each region for re-application 21 across the width direction, the adhesive 3 is applied on the back surface of the both end portions of each separated region for re-application 21 in the width direction. Therefore, it is possible to apply the separated region for re-application 21 to a different object of application without causing the both end portions to lift.

As described above, according to this embodiment, label main bodies 2 each include a back surface to which adhesive 3 is applied and a region for re-application 21 is defined by a label separation cut line 4 in a closed state. A strip-shaped backing liner 1 is in a shape of a strip along which the plurality of label main bodies 2 are arranged and temporarily attached at intervals. The strip-shaped backing liner 1 is provided with the plurality of re-separation backing partial regions 12 at intervals across the width direction perpendicular to the arrangement direction so as to correspond to the region for re-application 21 defined in each label main body 2. Each re-separation backing partial region is defined by the backing separation cutting line 5 in a closed state and provided over a range wider than the region for re-application 21 in the direction of the arrangement of the label main bodies 2. The region that is between the adjacent re-separation backing partial regions 12 in the width direction and to which the re-separation backing partial region 12 is not temporarily attached at the back surface of the region for re-application 21 is processed as a non-adhesive region 31. The region between the adjacent re-separation backing partial regions 12 remains even in the state in which the label main body 2 has been separated and the re-separation backing partial regions 12 have been removed with this, it is possible to ensure the tensile strength of the strip-shaped backing liner 1 from which the label main body 2 has been separated in the arrangement direction even when the regions for re-application 21 are provided in a wide range across the width direction perpendicular to the arrangement direction. Consequently, there is provided an advantageous effect that the strip-shaped backing liner 1 may not be cut up when the label main body 2 is separated from the strip-shaped backing liner 1 by transferring the strip-shaped backing liner 1 along the arrangement direction using the automatic printing and labeling machine 90.

Further, according to this embodiment, the re-separation backing partial regions 12 on the both ends across the width direction are provided so as to respectively include the both end portions of the region for re-application 21 across the width direction. This provides an advantageous effect that the adhesive 3 is applied on both end portions of the back surface of the separated region for re-application 21 in the width direction and it is possible to apply the separated region for re-application 21 to a different object of application without causing the both end portions to lift.

Moreover, according to this embodiment, the pickable portion 22 enclosed by the label separation cut line 4 in a closed state is provided continuously from one of the end portions of each region for re-application 21 across the width direction, as the portion from which separation of the corresponding region for re-application 21 starts. In addition, the non-adhesive region 31 is provided so as to slightly extend over the re-separation backing partial regions 12 on the both sides in the width direction. This has an advantageous effect in that it is possible to separate the region for re-application 21 from the re-separation backing partial region 12 smoothly when separating in the width direction.

It should be appreciated that the present invention is not limited to the above embodiment, and the embodiment can be modified accordingly within the scope of the technical ideas of the present invention. Further, the number, position, and shape of the component members described above are not limited to those described in the embodiment, and it is possible to employ any number, position, and shape that are suitable for implementation of the present invention. Moreover, the like components are denoted by the like reference numerals throughout the drawings.

The invention claimed is:

1. At least one label, each label having at least one region for re-application configured to be re-separated from a first object of application after application and to be re-applied to a second object of application, each label comprising:

a main body having a back surface to which an adhesive is applied and at least one region for re-application which is defined by a label separation cutting line which is in a closed state around the region for re-application; wherein a strip-shaped backing liner has an arrangement direction along which a plurality of label main bodies are arranged and temporarily attached at intervals along the backing liner between the main bodies, and wherein a plurality of re-separation backing regions is provided on the backing liner at intervals across a width direction which is perpendicular to the arrangement direction and corresponding to each region for re-application defined in each label main body, a backing separation cut line shaped in a closed state defining each re-separation backing region in the backing liner and the cut line shape being provided over a wider range than the region for re-application in the arrangement direction, a dimension of each region for re-application in the width direction being greater than a dimension in the width direction of each of the plurality of re-separation backing regions corresponding to the region for re-application, and a non-adhesive region is provided between adjacent re-separation backing regions in the width direction which is not temporarily attached in the back surface of the region for re-application.

2. The at least one label having at least one region for re-application according to claim 1, wherein the re-separation backing regions have ends across the width direction and both of the ends respectively include both end portions of the region for re-application across the width direction.

3. The at least one label having at least one region for re-application according to claim 2 further comprising:

a pickable portion enclosed and defined by the label separation cutting line in a closed state continuous from one end portion of each region for re-application across the width direction, so that separation of the corresponding region for re-application may be started at the pickable portion and wherein the non-adhesive region extends slightly over the re-separation backing regions on both sides in the width direction.

4. The at least one label having at least one region for re-application according to claim 1 further comprising:

a pickable portion enclosed and defined by the label separation cutting line in a closed state continuous from one end portion of each region for re-application across the width direction, so that separation of the corresponding region for re-application may be started at the pickable portion and wherein the non-adhesive region extends slightly over the re-separation backing regions on both sides in the width direction.

* * * * *